US009365908B2

(12) United States Patent
Butler et al.

(10) Patent No.: US 9,365,908 B2
(45) **Date of Patent: *Jun. 14, 2016**

(54) METHOD AND APPARATUS FOR NON-CONTACT SURFACE ENHANCEMENT

(75) Inventors: Thomas J. Butler, Enumclaw, WA (US); Daniel G. Alberts, Renton, WA (US); Daniel A. Woodward, Auburn, WA (US); Nicholas Cooksey, Seattle, WA (US)

(73) Assignee: ORMOND, LLC, Auburn, WA (US)

( * ) Notice: Subject to any disclaimer, the term of this patent is extended or adjusted under 35 U.S.C. 154(b) by 392 days.

This patent is subject to a terminal disclaimer.

(21) Appl. No.: 13/605,471

(22) Filed: Sep. 6, 2012

(65) Prior Publication Data

US 2013/0233040 A1 Sep. 12, 2013

Related U.S. Application Data

(60) Provisional application No. 61/531,776, filed on Sep. 7, 2011, provisional application No. 61/542,710, filed on Oct. 3, 2011.

(51) Int. Cl.
*C21D 7/06* (2006.01)
*C21D 1/09* (2006.01)

(52) U.S. Cl.
CPC ... *C21D 1/09* (2013.01); *C21D 7/06* (2013.01)

(58) Field of Classification Search
CPC ..... C21D 7/06; C21D 10/00; C21D 10/005; C21D 7/04; C21D 9/0018; B21D 26/02; B08B 3/02; B05B 1/00; B24C 1/10
USPC ..... 72/53, 54; 29/90.7
See application file for complete search history.

(56) References Cited

U.S. PATENT DOCUMENTS

| | | | | |
|---|---|---|---|---|
| 3,688,511 | A | 9/1972 | Harmstrof | |
| 3,834,200 | A | 9/1974 | Winter | |
| 4,172,974 | A | 10/1979 | Stingelin et al. | |
| 4,365,493 | A | 12/1982 | Feld et al. | |
| 4,772,304 | A | 9/1988 | Nakae et al. | |
| 5,048,316 | A * | 9/1991 | Thompson | B24C 7/0053 451/102 |
| 5,086,974 | A | 2/1992 | Henshaw | |
| 5,117,366 | A | 5/1992 | Stong | |
| 5,305,361 | A | 4/1994 | Enomoto et al. | |
| 5,553,106 | A | 9/1996 | Enomoto et al. | |
| 5,584,016 | A | 12/1996 | Varghese et al. | |
| 5,704,824 | A | 1/1998 | Hashish et al. | |
| 5,749,384 | A | 5/1998 | Hayashi et al. | |
| 5,778,713 | A * | 7/1998 | Butler | B24C 1/003 451/39 |
| 5,897,062 | A | 4/1999 | Enomoto et al. | |

(Continued)

FOREIGN PATENT DOCUMENTS

WO 2007/124396 11/2007

*Primary Examiner* — Alexander P Taousakis
*Assistant Examiner* — Peter Iannuzzi
(74) *Attorney, Agent, or Firm* — George C. Rondeau, Jr.; Davis Wright Tremaine LLP

(57) ABSTRACT

Systems and methods to generate beneficial residual stresses in a material, clean, strip coatings from, or roughen surfaces by generating cavitation shock waves without damaging the surface of the material. Shock waves emanate through the target material from collapsing cavitation voids in and around a liquid jet to generate residual stresses without impinging the jet against the material, or by impinging the material at shallow angles, and without significantly damaging or deforming the surface of the target material.

11 Claims, 7 Drawing Sheets

(56) References Cited

U.S. PATENT DOCUMENTS

| | | | | |
|---|---|---|---|---|
| 5,932,120 | A | 8/1999 | Mannava et al. | |
| 6,058,153 | A | 5/2000 | Kurosawa et al. | |
| 6,153,023 | A | 11/2000 | Rokutanda | |
| 6,240,155 | B1 | 5/2001 | Kurosawa et al. | |
| 6,280,302 | B1 | 8/2001 | Hashish et al. | |
| 6,341,151 | B1 | 1/2002 | Enomoto et al. | |
| 6,345,083 | B1 | 2/2002 | Enomoto et al. | |
| 6,358,120 | B1 | 3/2002 | Poling et al. | |
| 6,425,276 | B1 * | 7/2002 | Hirano | B24C 1/10 134/10 |
| 6,464,567 | B2 | 10/2002 | Hashish et al. | |
| 6,502,442 | B2 | 1/2003 | Arola et al. | |
| 6,519,991 | B2 | 2/2003 | Hirano et al. | |
| 6,630,247 | B1 | 10/2003 | Fox et al. | |
| 6,639,962 | B2 * | 10/2003 | Enomoto | C21D 7/06 376/249 |
| 6,752,686 | B1 | 6/2004 | Hashish et al. | |
| 6,855,208 | B1 * | 2/2005 | Soyama | B24C 1/10 134/1 |
| 6,945,859 | B2 | 9/2005 | Hashish et al. | |
| 6,981,906 | B2 | 1/2006 | Hashish et al. | |
| 7,276,824 | B2 | 10/2007 | Statnikov et al. | |
| 7,419,418 | B2 | 9/2008 | Alberts et al. | |
| 7,699,449 | B2 | 4/2010 | Yoshino et al. | |
| 7,716,961 | B2 | 5/2010 | Hatou et al. | |
| 7,720,190 | B2 | 5/2010 | Shimamura et al. | |
| 7,789,734 | B2 | 9/2010 | Swift et al. | |
| 7,884,924 | B2 | 2/2011 | Numata et al. | |
| 2002/0032498 | A1 | 3/2002 | Mattke et al. | |
| 2002/0079602 | A1 | 6/2002 | Pfeiffer | |
| 2003/0065424 | A1 | 4/2003 | Erichsen et al. | |
| 2003/0120375 | A1 | 6/2003 | Arai et al. | |
| 2003/0139041 | A1 | 7/2003 | LeClair | |
| 2003/0208296 | A1 | 11/2003 | Brisson et al. | |
| 2004/0004055 | A1 | 1/2004 | Barros | |
| 2004/0237713 | A1 | 12/2004 | Breslin et al. | |
| 2004/0250584 | A1 * | 12/2004 | Offer | B23P 9/04 72/56 |
| 2005/0103362 | A1 | 5/2005 | Soyama | |
| 2008/0130819 | A1 | 6/2008 | Ortega et al. | |
| 2009/0124169 | A1 | 5/2009 | Alberts et al. | |
| 2010/0242660 | A1 | 9/2010 | Offer et al. | |
| 2011/0005288 | A1 | 1/2011 | Matsui et al. | |
| 2011/0232348 | A1 | 9/2011 | Hatou et al. | |

* cited by examiner

METHOD AND APPARATUS FOR NON-CONTACT SURFACE ENHANCEMENT

CROSS REFERENCE TO RELATED APPLICATIONS

This application claims priority to U.S. Provisional Application No. 61/531,776, filed Sep. 7, 2011, and U.S. Provisional Application No. 61/542,710, filed Oct. 3, 2011, both entitled "Method and Apparatus for Non-contact Surface Enhancement," which are hereby incorporated by reference in their entirety.

FIELD OF THE INVENTION

The present invention relates generally to systems and methods of surface enhancement, and more particularly, to systems and methods of surface enhancement by liquid cavitation jet action on or near a material to be processed ("target material").

BACKGROUND OF THE INVENTION

The following description includes information that may be useful in understanding the present invention. It is not an admission that any of the information provided herein is prior art or relevant to the presently claimed invention, or that any publication specifically or implicitly referenced is prior art.

The most common method of surface enhancement is shot peening, where small particles or balls (shot) are impacted against the target material to deform the surface. The shot is typically propelled with compressed air using automated equipment to move the peening nozzle over the surface of the part to be peened. The shot, frequently steel or ceramic, is usually accelerated to 50-100 m/s by the compressed air and strikes the surface with enough energy to deform the top layer of material beyond its elastic limit.

This plastically deformed surface induces residual compressive stresses in the material as the material underneath, which is not plastically deformed, tries to push the plastically deformed material back into its original volume. This "pushing" is the compressive stress that is a beneficial material property.

Variations on this method include striking the surface with particles spun off from a rotating wheel, low plasticity burnishing with a ball that is hydraulically pressed into the surface as it rolls across the part, and laser shock peening (LSP).

Cavitation peening is another method that involves shooting a high-pressure liquid jet against the target material in such a manner that cavitation bubbles collapse and shock waves pass into the material. Cavitation peening is generally performed with the liquid jet and the target material both submerged in a liquid. The shock waves generate compressive residual stresses in the target material similar to the other methods described above. However, cavitation peening has traditionally presented several shortcomings, such as limited stress depth and limited process rates, as has been known to cause damage to the surface of the peened material.

Examples of cleaning or stripping methods may include removal of scale, oxides, chrome coatings, thermal barrier coatings, or others. Examples of surface roughening applications include roughening metals or ceramics to create a desirable bonding surface geometry for coatings or bonding agents.

Low cost, easy to implement, and improved performance methods of accomplishing the above processes and objectives are needed and are provided by embodiments of the present invention.

BRIEF DESCRIPTION OF THE DRAWINGS

Exemplary embodiments are illustrated in the referenced figures. It is intended that the embodiments and figures disclosed herein are to be considered illustrative rather than restrictive.

DESCRIPTION OF THE INVENTION

Figure 1:
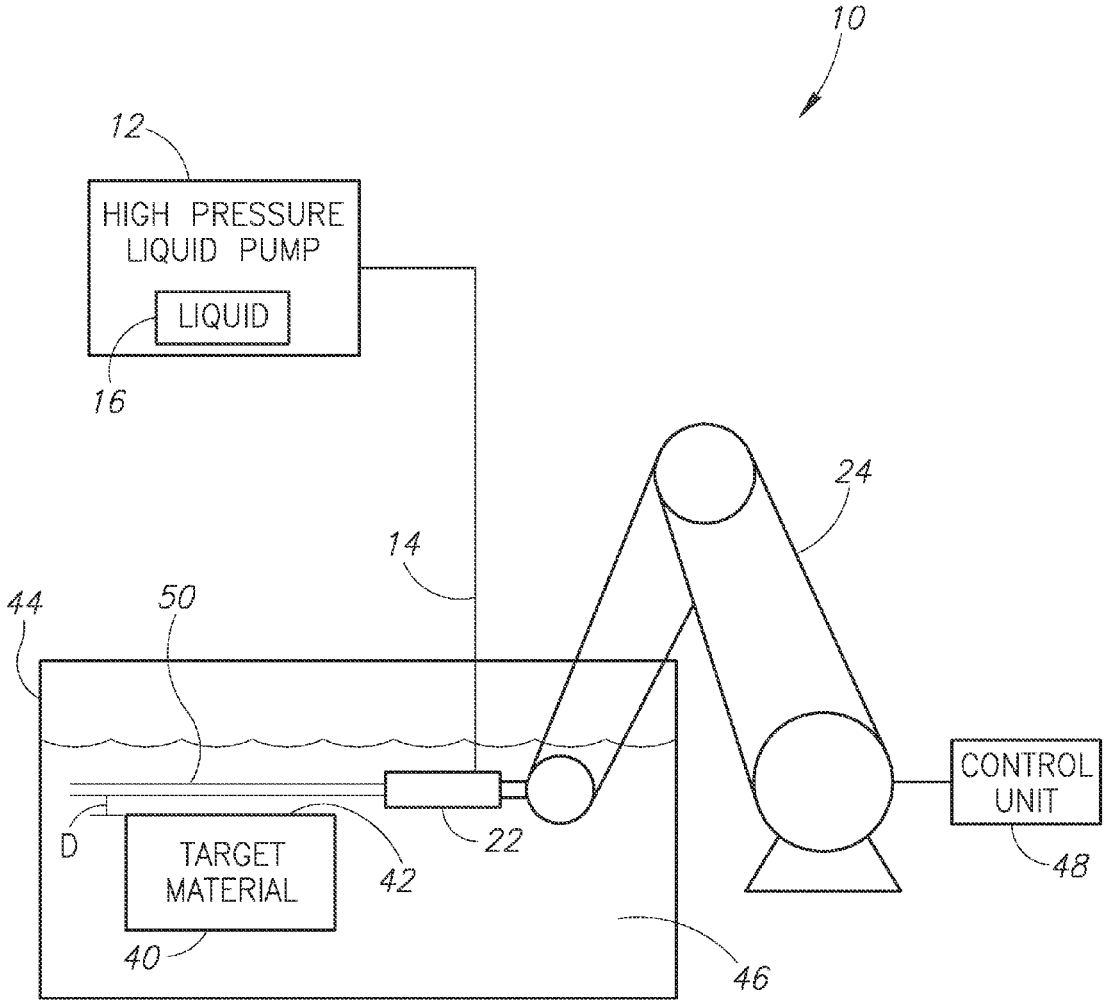
FIG. 1 illustrates a schematic diagram of a peening system according to an embodiment of the present invention.

One skilled in the art will recognize many methods, systems, and materials similar or equivalent to those described herein, which could be used in the practice of the present invention. Indeed, the present invention is in no way limited to the methods, systems, and materials described.

Methods of inducing residual compressive stresses in materials are desired in order to improve properties such as resistance to fatigue failure and stress corrosion cracking. Further, methods are needed to clean, strip coatings from, or roughen surfaces in difficult applications. High-speed methods of performing the above mentioned processes without damaging the processed target material are needed as an improvement over current methods.

The inventors have recognized that all of the aforementioned methods have various shortcomings and limitations. Some or all of these shortcomings and limitations are remedied by the embodiments of the present invention discussed below. What follows is a discussion of some of the recognized shortcomings of past peening methods.

Conventional shot peening only produces relatively shallow compressive stresses, typically less than 0.25 mm deep. It also has the considerable drawback of roughening up the surface to be peened, thereby causing a limitation to the improvement in fatigue life.

Low plasticity burnishing is limited to accessible geometry that will allow access to the rolling ball and hydraulic actuators. Ultrasonic peening, such as described in U.S. Pat. No. 7,276,824, is faced with similar limitations.

Laser shock peening is comparatively slow and very expensive. The equipment typically costs millions of dollars per station. The materials that can be processed using this method are limited, and this method is difficult to deploy under water. It is also difficult to apply laser peening to confined spaces, such as inside of small-diameter tubes or cavities.

Cavitation peening is lower cost than laser shock peening but has traditionally been more expensive than conventional peening, due in part to long process times. The residual stresses generated using cavitation peening can be deeper than conventional peening. U.S. Pat. No. 5,778,713 describes a cavitation peening method that shoots the liquid jet directly at the target material to perform peening. However, that invention is stated to be suitable for metal materials only and the direct impingement of the liquid jet requires utilization of a fine resolution raster pattern to cover the surface with the small jet footprint, requiring a significant amount of process time. The direct impingement method can also cause surface damage by erosion caused by the high velocity liquid jet that acts upon the surface of the material, thus limiting the available developed stress intensity. This is particularly true if the process time is long enough to provide the desired stress intensity and depth.

U.S. Pat. No. 5,897,062 is another cavitation peening method that directly impinges the liquid jet on the material surface, can cause damage to the material surface, and is limited to jet pressures of 3,000 to 15,000 psi. Such low pressures result in low stress intensity and depth unless a high flow rate and long process time are provided. The high jet flow rate would require excessively heavy tooling due to the high reaction forces that would be present. This is especially prohibitive in remotely performed applications, such as nuclear reactor peening. The relatively long process time results in an overly costly method.

U.S. Pat. No. 6,345,083 describes a method of cavitation peening without aiming the high-pressure liquid jet directly at the material, but mechanical deflectors are required to reflect the jet into the material thus weakening the jet power and requiring frequent tool replacement due to tool erosion by the jet.

It is noted that methods such as burnishing, laser shock peening, or methods using lower pressure cavitation peening (which requires higher volume) can be difficult to impossible to deploy in many applications due to the tool loading or support equipment that is required.

Conventional cleaning and coating removal methods often involve the undesired use of chemicals or destructive mechanical methods. Some of the above mentioned prior processes utilize cavitation and discuss surface cleaning—however, the direct impingement of the high velocity liquid jets cause damage to the substrate material when tough coatings are to be removed due to erosion by the high velocity liquid jet. U.S. Pat. No. 5,086,974 discloses a direct impingement cavitating liquid jet method for removing paint. However, the energy level of the liquid jet must be severely restricted so that the substrate material is not damaged, and the method cannot be used for more difficult coatings such as metallic plating or ceramic coatings.

Embodiments of the present invention overcome one or more of the aforementioned limitations by providing a submerged pressurized liquid jet that does not impinge directly against the target material. This is accomplished by aiming a high-pressure liquid jet substantially tangential or parallel to the surface of the target material to be processed. This method allows the use of cavitation for peening or surface cleaning without the damaging effects of a direct impingement high-pressure liquid jet.

FIG. 1 is a schematic block diagram of a cavitation or peening system in accordance with an embodiment of the present invention. The system 10 comprises a high pressure liquid pump 12 that is provided to generate liquid pressures that are preferably between 15,000 psi to 200,000 psi, or higher. A rigid or flexible high-pressure liquid conduit 14 is provided to couple pressurized liquid 16 from the pump 12 to an input port of a peening head comprising a nozzle 22. The liquid 16 may comprise liquid water, cryogenic liquid, liquid rust inhibitor, or other suitable liquid. As an example, the pump 12 may be a KMT Waterjet Streamline V, a Flow International 20X pump, or other suitable pumps.

The nozzle 22 (or a plurality of nozzles) is mounted to a robotic manipulator 24 configured to provide relative motion between the nozzle 22 and a target material 40 (e.g., the portion thereof to be processed). The nozzle 22 and the target material 40 are submerged in a tank 44 of liquid 46. The relative motion between the nozzle 22 and the target material 40 is designed such that a high-pressure liquid jet 50 passes proximate to or in contact with a surface 42 of the target material 40 in areas that are desired to be processed. The robotic manipulator 24 may be coupled to a computer control unit 48 configured to preprogram and control the movement of the nozzle 22 in a plurality of dimensions and to control the starting and stopping of the process (e.g., by controlling the operation of the pump 12, etc.) using pre-programmed instructions. Alternatively, the target material 40 may be mounted on the robotic manipulator 24 to provide the relative motion with the nozzle 22 being stationary. A further alternative is that both the nozzle 22 and the target material 40 are mounted on separate robotic manipulators 24 to provide the relative motion. Additionally, the nozzle 22 could also be held by a person and pointed at the surface 42 of the target material 40, wherein the operator manually moves the nozzle 22 to process a desired area of the material. As an example, the robotic manipulator 24 may be a Flying Bridge available from Flow International, a PAR Vector CNC, or other suitable robotic manipulator. An additional alternative is that, if only a small area is to be processed in one operation, processing may be performed with little or no relative motion between the nozzle 22 and the target material 40.

Another example of a robotic motion device is a remotely operated vehicle. The robotic motion device can be pre-programmed or may be operated manually to create the desired relative motion between the nozzle 22 and the material 40 so that a cavitation footprint 54 (see FIGS. 3A-3B) covers the area to be processed. There may also be tooling to hold the processed material 40 or to mount the robotic motion device 24.

Figure 2:
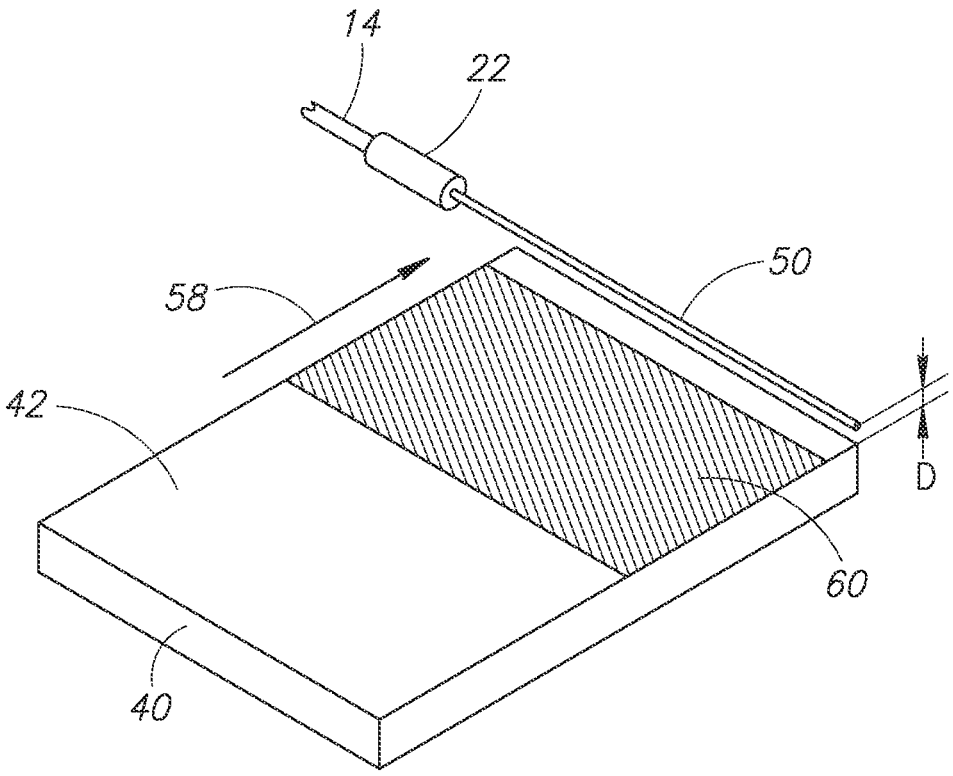
FIG. 2 is a perspective view illustrating a method of processing a target material using the peening system of FIG. 1 wherein a liquid jet is oriented parallel to the surface of the target material and does not strike the surface.

FIG. 2 illustrates a perspective view of the nozzle 22 configured to direct the liquid jet 50 in a direction substantially parallel to the surface 42 of the material 40 at a stand-off distance D. In this example, the nozzle 22 moves in the direction of the arrow 58 creating a processed area 60 of the surface 42 of the material 40. In this example, the liquid jet 50 is substantially parallel to the surface 42 of the material 40 and the jet is operated at a stand-off distance D of approximately 0.010 inches (0.0254 cm) to 2.00 inches (5.08 centimeters) away from the surface of the material.

Figure 3A:
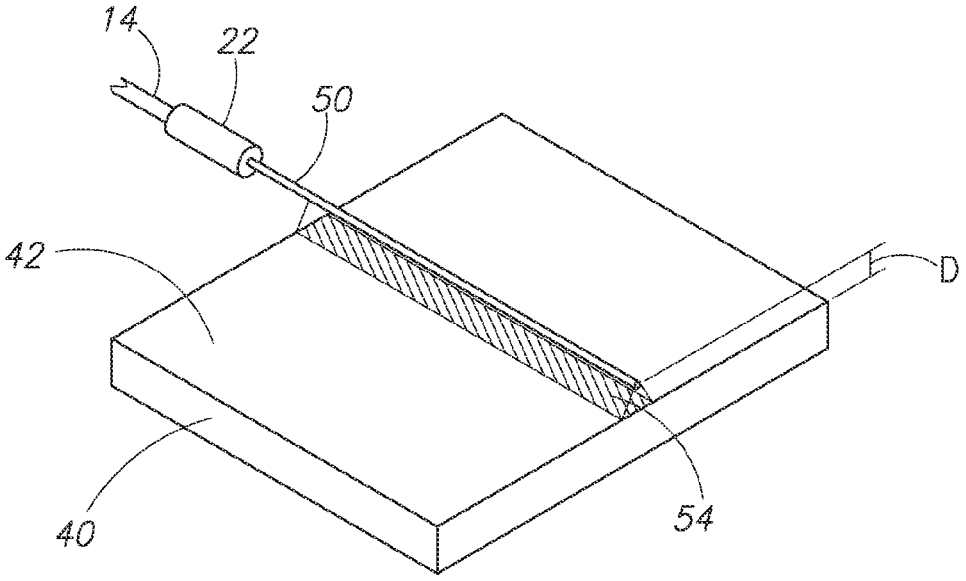
FIG. 3A is a perspective view of a footprint of the cavitation jet of the peening system on a surface of the target material.
Figure 3B:
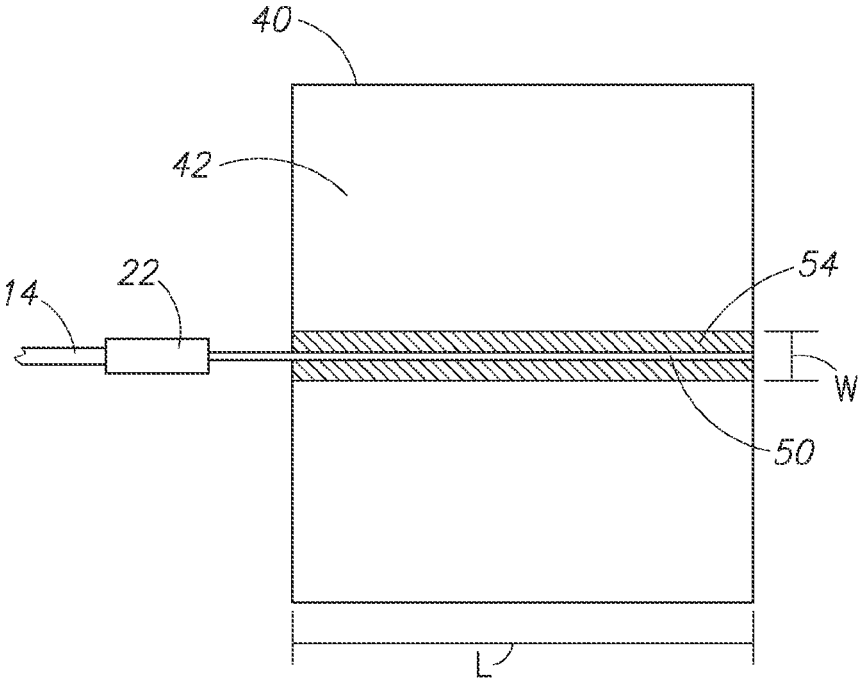
FIG. 3B illustrates a top view of the footprint of the cavitation jet of the peening system on the surface of the target material.

As shown in FIGS. 3A and 3B, embodiments of the present invention also support significantly higher processing rates due to the much larger cavitation footprint 54 on the surface 42 of the target material 40 and the higher power capacity. The parallel flow of the liquid jet 50 over the surface 42 creates the elongated footprint 54 that has a width W that is greater than the cross-sectional diameter of the liquid jet and a length L that corresponds to the portion of the liquid jet that passes over the surface 42 with sufficient energy to process the surface. This is in contrast to a direct impingement liquid jet footprint that will normally have a diameter of about 1 mm (e.g., approximately the cross-sectional diameter of the liquid jet). The substantially parallel orientation of the liquid jet 50 is can increase the processing rate by a factor of 100 times in many cases because the cavitation footprint 54 of the parallel oriented jet 50 can be 100 or more times the area of the diameter of the liquid jet.

Figure 6:
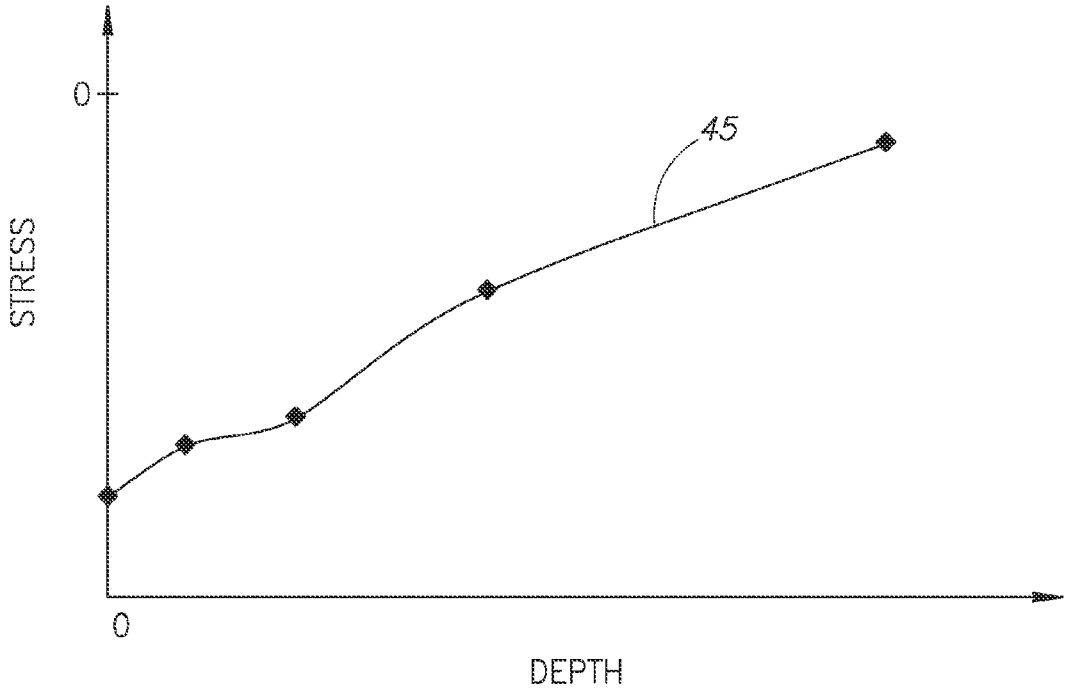
FIG. 6 illustrates a unit-less curve of residual stress vs. depth below the surface of the material that can be generated using the peening system of FIG. 1.

Further, the non-contact jet 50 allows the use of higher pressure, higher velocity, more intense cavitation jets, without damaging the surface 42 by direct contact of the high velocity liquid jet against the material 40. Because there is little danger of damaging the material 40, embodiments of the present invention allow intense cavitation peening and result in improved residual stress results compared to direct impingement peening. A unit-less example of a stress-depth curve 45 that can be generated using the peening system 10 is shown in FIG. 6. The methods disclosed herein are operative to peen metals as well as other materials such as ceramics, glass, composites, and plastics. Similarly, tougher coatings can be removed using the methods disclosed herein where past practice methods fail.

When roughening surfaces, embodiments of the invention may be used to provide extremely well controlled consistent finishes for the surface 42 because the finish is created by action of cavitation only and is not influenced by liquid jet erosion. Because the liquid jet 50 does not contact the surface 42, high-energy cavitation jets can be utilized without danger of erosion caused by the jets.

Embodiments of the present invention are easily deployed because the cavitation nozzle 22 can be small, lightweight, and in some embodiments (ultra-high pressure/low flow rate embodiments), the reaction load on the manipulator 24 or processed material 40 is relatively very low. A significant benefit of the invention is that the system 10 is operative to, with a single tool, perform one or a combination of processes including cleaning material surfaces, removing coatings from materials, roughening material surfaces, and/or generating beneficial compressive residual stresses or reducing tensile residual stresses in materials.

As discussed above, some embodiments of the present invention use the high-pressure liquid jet 50 to generate cavitation that peens materials, thereby creating beneficial compressive residual stresses. The process relies on shock waves induced by cavitation bubbles collapsing on the surface 42 of the material 40 to be peened, instead of deformation of the surface. The process may be performed with the nozzle 22, liquid jet 50, and the processed material 40 submerged in the tank 44 of liquid 46 (see FIG. 1). The liquid 46 in the tank may be, for example, water, oil, various liquids in solution with other liquids, liquids with dissolved solids added, or other liquids.

Figure 4:
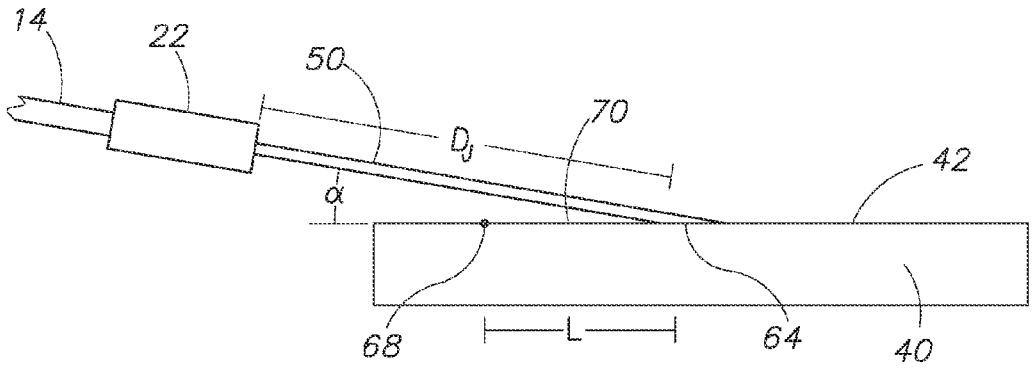
FIG. 4 illustrates a side elevational view of the peening system when directing a liquid jet at the target material at a shallow angle.

As shown in FIG. 4, in some embodiments the liquid jet 50 may be oriented at a shallow angle α relative to the surface 42 of the material 40, rather than substantially parallel therewith. For example, the angle α may be approximately 0 degrees to 10 degrees. As will be appreciated, a higher flow rate jet 50 may be used if the jet is positioned farther away from the material 40.

Figure 5A:
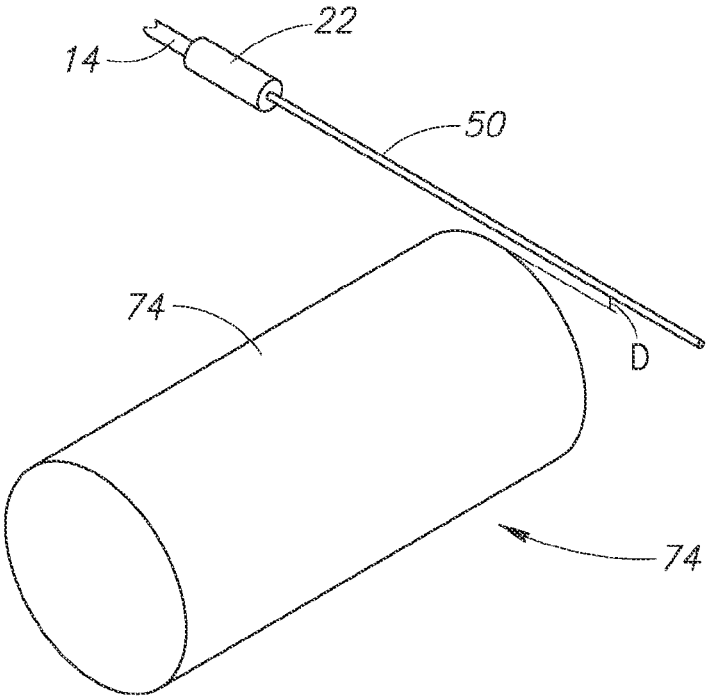
FIG. 5A illustrates a method of peening a cylindrically-shaped target material by orienting a liquid jet substantially tangent to a curved surface of the target material.
Figure 5B:
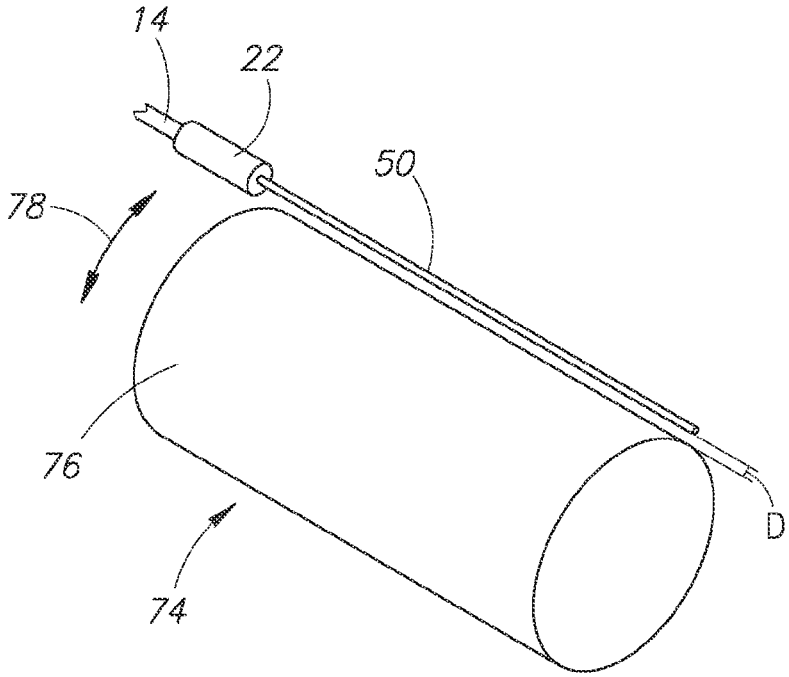
FIG. 5B illustrates a method of peening a cylindrically-shaped target material by orienting a liquid jet substantially along a longitudinal axis of the target material.

FIGS. 5A and 5B illustrate use of the system 10 to process an exterior curved surface 76 of a cylindrically-shaped material 74. In FIG. 5A, the jet 50 is oriented roughly tangent to the curve of the surface 76. In FIG. 5B, the jet 50 is oriented along a longitudinal axis of the cylindrically-shaped material 74. As indicated by the arrow 78 in FIG. 5B, the nozzle 22 may rotate in a circle to direct the jet 50 along the surface 76 of the material 74, maintaining a stand-off distance D throughout the rotation. It should be appreciated that the jet 50 may be also positioned at an angle to the longitudinal axis of the material 74 in other embodiments. For irregular surfaces, the jet 50 may be oriented roughly parallel to the mean of the surface, or within roughly 10 degrees from the mean of the surface. This orientation maximizes the cavitation footprint of the jet 50 and maximizes the process rate, while preventing damage to the surface of the material caused by a direct impingement of a high-pressure liquid jet.

If the jet 50 is oriented off-parallel to the surface 42 of the material 40 as shown in FIG. 4, the jet will strike the surface 42 at a contact point 64 at the angle α of up to 10 degrees and flow over the surface 42. Such shallow angles still normally avoid erosion damage to the surface 42 of the material 40. The jet 50 covers large areas in this fashion, without causing significant erosion damage, and with improved performance. For example, a portion 70 of the top surface 42 may be processed between the contact point 64 and a point 68 between the contact point and the nozzle 22 whereat the jet 50 is close enough to effect cavitation peening on the surface. The particular footprint is dependent on the pressure, type of nozzle, type of liquid, orientation angle α, type of material 40, and other factors. When the jet 50 is oriented at a shallow angle to strike the surface 42 of the material 40, the distance from the nozzle 22 to the contact point 64 where the jet strikes the surface 42 may be referred to a jet distance $D_J$. The distance $D_J$ may be approximately 2 inches (5.08 cm) to 8 inches (20.32 cm), depending on the application and jet flow rate.

The nozzle 22 and jet 50 can be passed over the material 40 to cover large areas, or alternatively, can be operated momentarily at a stationary location over the material to process a limited area. In the latter case, the jet 50 can then be turned off and moved to another location and operated a multiple of times to provide the desired coverage.

This invention can be used on shapes ranging from simple flat or cylindrical materials, to complex shapes such as gears, turbines, or nuclear reactor core components.

Examples of liquids that may be used as the peening liquid 16 may include water, oil, liquid rust inhibitor, a solution of one liquid containing other liquid, or a solution of a liquid containing dissolved solids. The liquid 16 may be supplied to the nozzle 22 at pumped pressures of 15,000 to 200,000 psi, or higher. A non-limiting example nozzle 22 may have an orifice opening diameter of between approximately 0.003 inches (0.00762 cm) and 0.25 inches (0.635 cm). The cavitation jet 50 can be operated when the surrounding liquid 46 (see FIG. 1) is at ambient atmospheric pressure or when the ambient pressure is elevated.

Figure 7:
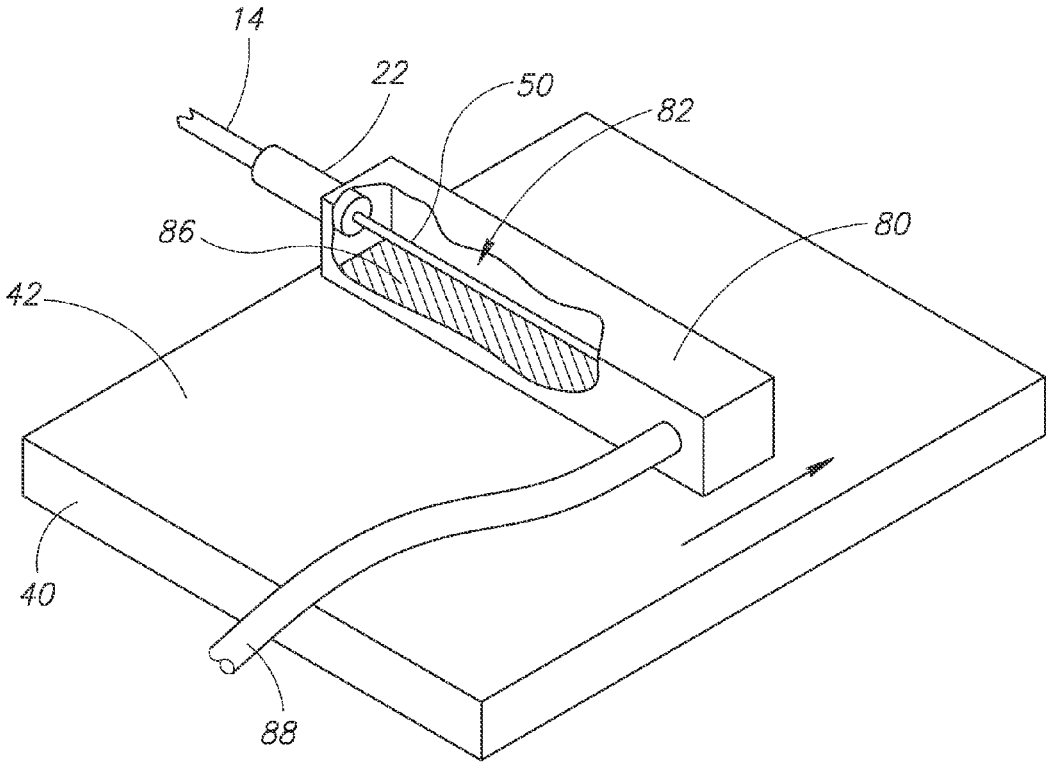
FIG. 7 is a perspective view illustrating a method of processing a target material using the peening system of FIG. 1 wherein a liquid jet is oriented parallel to the surface of the target material and does not strike the surface and the jet and target material are submerged in a liquid within a shroud.

FIG. 7 is a perspective view illustrating a method of processing the target material 40 using the peening system 10 of FIG. 1 wherein the liquid jet 50 is oriented parallel to the surface 42 of the target material and does not strike the surface. In this embodiment, the nozzle 22 is coupled to a shroud 80 having an interior portion 82 configured for receiving a liquid (not shown for clarity) from a liquid conduit 88 coupled to the shroud. The shroud 80 is open at the bottom exposing a shrouded portion 86 of the surface 42 of the material 40 to the liquid. Thus, the jet 50 and the shrouded portion 86 of the target material 40 are submerged in a liquid. In operation, the nozzle 22 and shroud 80 may be moved over the surface 42 to process the material 40 as desired. This method may be beneficial in applications where it is not feasible to submerge the target material into the liquid tank 44.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

What is claimed is:

1. A method of cavitation peening a target material, the method comprising:

providing a volume of a first liquid;

pressurizing a second liquid to a pressure greater than 15,000 pounds per square inch (PSI);

submerging a target surface of the target material in the first liquid;

forming a high velocity liquid jet from the pressurized second liquid; and directing the high velocity liquid jet through the first liquid over and near the target surface of the target material in a direction substantially parallel to the target surface without the pressurized second liquid striking the target surface to increase beneficial residual stresses in the target material, the high velocity liquid jet emanating a cavitation layer directly contacting and treating an area of the target surface, the cavitation layer having a length at least as long as a portion of the high velocity liquid jet travelling over and substantially parallel to the target surface.

2. The method of claim 1, wherein the second liquid comprises liquid water.

3. The method of claim 1, wherein the second liquid comprises liquid rust inhibitor.

4. The method of claim 1, wherein the second liquid comprises liquid oil.

5. The method of claim 1, wherein the second liquid comprises liquid water containing dissolved solids.

6. The method of claim 1, wherein submerging the target surface of the target material in the first liquid comprises utilizing a shroud to retain the first liquid adjacent the target surface, the shroud extending in a direction parallel to the target surface.

7. The method of claim 1, further comprising directing the high velocity liquid jet such that the high velocity liquid jet maintains a stand-off distance from the target surface of between 0.010 inches and 2.00 inches, the stand-off distance being a distance between a length of the high velocity liquid jet and a corresponding substantially parallel length of the target surface of the target material over which the length of the high velocity liquid jet is directed.

8. A method of cavitation peening a target material, the method comprising:

providing a volume of a first liquid;

pressurizing a second liquid;

submerging a target surface of the target material in the first liquid;

forming a high velocity liquid jet from the pressurized second liquid; and directing the high velocity liquid jet in a direction over and substantially parallel to the target surface to create a cavitation layer directly contacting and treating an area of the target surface, the cavitation layer emanating from the high velocity liquid jet and having a length at least as long as the high velocity liquid jet travelling over and substantially parallel to the target surface.

9. The method of claim 8, wherein the high velocity liquid jet is directed in a direction avoiding the pressurized second liquid from striking the target surface.

10. The method of claim 8, wherein the second liquid is pressurized to a pressure greater than 15,000 pounds per square inch (PSI).

11. The method of claim 8, wherein a width of the cavitation layer is greater than a cross-sectional diameter of the high velocity liquid jet.

* * * * *